US008439726B2

(12) United States Patent
Miller

(10) Patent No.: US 8,439,726 B2
(45) Date of Patent: May 14, 2013

(54) CUTTING HEADS

(75) Inventor: Donald Stuart Miller, Harrold (GB)

(73) Assignee: Finecut AB (SE)

( * ) Notice: Subject to any disclaimer, the term of this patent is extended or adjusted under 35 U.S.C. 154(b) by 490 days.

(21) Appl. No.: 12/083,954

(22) PCT Filed: Nov. 2, 2006

(86) PCT No.: PCT/GB2006/004084

§ 371 (c)(1),
(2), (4) Date: Feb. 27, 2009

(87) PCT Pub. No.: WO2007/052027

PCT Pub. Date: May 10, 2007

(65) Prior Publication Data

US 2009/0258582 A1 Oct. 15, 2009

(30) Foreign Application Priority Data

Nov. 3, 2005 (GB) ..... 0522444.9

(51) Int. Cl.
*B24C 5/04* (2006.01)

(52) U.S. Cl.
USPC ..... 451/102; 451/90

(58) Field of Classification Search ..... 451/102, 451/90, 39, 40, 38
See application file for complete search history.

(56) References Cited

U.S. PATENT DOCUMENTS

| | | | | |
|---|---|---|---|---|
| 3,419,220 | A * | 12/1968 | Goodwin et al. | 239/591 |
| 4,233,785 | A | 11/1980 | Abell | |
| 5,152,449 | A | 10/1992 | Mizuhara | |
| 2003/0133826 | A1 | 7/2003 | Lin | |
| 2005/0017091 | A1 | 1/2005 | Olsen et al. | |
| 2005/0230152 | A1 | 10/2005 | Joslin | |

FOREIGN PATENT DOCUMENTS

| | | |
|---|---|---|
| CH | 377674 | 5/1964 |
| CN | 2255876 Y | 6/1997 |
| GB | 2422566 | 8/2006 |
| RU | 2130809 C1 | 5/1999 |
| RU | 2167003 C2 | 5/2001 |
| SU | 589112 A1 | 1/1978 |

OTHER PUBLICATIONS

PCT Application No. PCT/GB2006/004084, International Search Report mailed Jan. 31, 2007, 3 pgs.

"Chinese Application Serial No. 200380108808.1, First Office Action issued Jul. 31, 2009", (English Translation), 12 pgs.

(Continued)

*Primary Examiner* — Robert Rose

(74) *Attorney, Agent, or Firm* — Schwegman Lundberg & Woessner, P.A.

(57) ABSTRACT

A nozzle assembly (1) generates a jet (9) of water, or abrasive particles suspended in water, for use in an abrasive waterjet-cutting head. The nozzle assembly (1) comprises a nozzle element (5, 80, 84, 86, 91) with a tapering bore (7) therethrough, mounted to a carrier (2, 52) so that the bore (7) is connected coaxially to a passage (4) through the carrier (2, 52), the bore (7) and passage (4) preferably having the same diameter where they meet. The nozzle element comprises a superhard material, such as diamond, in the form of a solid body (5, 81, 83, 86) or a coating (90). The nozzle element is mounted to the carrier (2, 52) by a brazed or soldered joint (6), extending normally to a longitudinal axis of the passage (4) and bore (7).

16 Claims, 4 Drawing Sheets

OTHER PUBLICATIONS

"International Application Serial No. PCT/.GB2006/004084, Written Opinion mailed Jan. 31, 2007", 4 pgs.

"Chinese Application Serial No. 200380108808.1, Response filed Dec. 14, 2009 to First Office Action issued Jul. 31, 2009", 9 pgs.

"Russian Application Serial No. 2008117450, Official Action dated Nov. 19, 2010", (English Translation), 7 pgs.

"Russian Application Serial No. 2008117450, Decision on Grant of a Patent for Invention", (w/ English Translation), (2011), 14 pgs.

"Chinese Application Serial No. 200680040752.4, Office Action dated Oct. 10, 2011", (w/ English Translation), 17 pgs.

* cited by examiner

CUTTING HEADS

RELATED APPLICATIONS

This application is a nationalization under 35 U.S.C. 371 of PCT/GB2006/004084, filed Nov. 2, 2006 and published as WO 2007/052027 A1, on May 10, 2007, which claimed priority under 35 U.S.C. 119 to United Kingdom Patent Application Serial No. 0522444.9, filed Nov. 3, 2005; which applications and publication are incorporated herein by reference and made a part hereof.

The present invention relates to cutting heads that generate abrasive waterjets using abrasive particles carried to a cutting head in a gas, or in a vapour or in a liquid.

Prior art abrasive waterjet cutting heads, known as AWJ cutting heads, discharge ultra high-pressure water at 4000 bar (400 MPa) or so through an orifice to form a waterjet travelling at over twice the speed of sound in air. A waterjet is projected 40 to 80 waterjet jet diameters across a chamber to enter a focus tube bore. Abrasive particles suspended in air are induced into a chamber by a waterjet dragging air with abrasive particles into a focus tube entryway and bore. Momentum is transferred from a waterjet to abrasive particles in a focus tube to produce a cutting jet at a tube outlet.

Transient events during closing of a shut off valve to stop a high velocity waterjet cause a momentary reversal of water/air flow in a waterjet orifice that can carry abrasive particles through an orifice. On restating water flow such particles pass through an orifice at high speed and can erode an orifice and a particle impacting on an orifice edge can cause an orifice to fail. Catastrophic edge damage also occurs from particles reaching an orifice in pressurised water. What is particularly troublesome is that failures are unpredictable and cause serious financial and production losses.

A waterjet orifice is located in the front face of a substantial carrier that can withstand ultra high water pressures. Water pressure acts to force an orifice onto a carrier and seal an orifice to a carrier. The number of abrasive particles reaching the vicinity of a waterjet orifice can be greatly reduced by projecting a waterjet for ten or so jet diameters along a narrow passageway in a carrier before a jet enters a chamber.

The risk of abrasive particles damaging a waterjet orifice is minimised by turning off an abrasive flow to a cutting head some time before stopping a waterjet so as to clear abrasive from a cutting head. Because of re-circulation of air and abrasive within a cutting head chamber a significant time delay is needed to clear abrasive from a cutting head. This time delay, combined with a time delay to establishing abrasive flow after a waterjet is turned on, prevents prior art abrasive waterjets being used for machining operations that requires a cutting jet to be turned on and off rapidly and this excludes their use for many applications.

US Patent Application 2005/0017091 describes an AWJ cutting head in which air is drawn from atmosphere to the passageway downstream of an orifice in order to avoid air carrying abrasive particles reaching a waterjet orifice. Although providing such airflow can prevent abrasive particles reaching and damaging an orifice and its holder it complicates the design of a cutting head and adversely affects the amount of air available to carry abrasive particles to a cutting head.

UK Patent Application No GB2422566A describes a method of generating abrasive waterjets that uses steam as a carrier fluid to transport abrasive particles to a cutting head for the steam to be condensed in a focus tube. Condensing steam, prior to a focus tube inlet, may need to be minimised in such cutting heads and this requires a focus tube inlet to be within 20 or so waterjet diameters of a waterjet generating means. Abrasive suspended in steam flows over the outlet face of a waterjet generating means. Because abrasive particles are in direct contact with a waterjet generating means particles are carried upstream of the waterjet generating means during flow transients on stopping water flow and when steam carrying abrasive particles flows to a cutting head when there is no water flow through a waterjet generating means.

To generate abrasive waterjets with diameters less than 300 μm or so by entrainment of abrasive particles into a high-speed waterjet it is necessary to suspend abrasive particles in water flowing to a cutting head rather than dynamically carrying particles in flowing air as used for AWJ cutting heads. Entraining abrasive suspended in water into a high speed waterjet has not been exploited for precision machining because of poor cutting head performance.

The geometries of prior art cutting heads that use water as the abrasive carrier fluid, induce adverse fluid dynamic interactions between a waterjet and dense abrasive/water mixture before mixture enters a focus tube bore. A requirement to avoid adverse fluid dynamic interactions is for the outlet of a waterjet generating means to be within 20 or so waterjet diameters of a focus tube inlet. This causes abrasive particles to flow over the outlet of a waterjet generating means resulting in abrasive particles reaching the inlet side of a waterjet generating means when water flow is stopped and when abrasive mixture enters a cutting head without pressurised water flowing through a waterjet generating means.

It is particularly important that a cutting head using abrasive/water mixtures has a waterjet generating means that is able to pass abrasive suspensions without undue wear. The abrasive for these cutting heads is statically suspended in water so cannot be easily cleared from the vicinity of a waterjet generating means before stopping of a water flow. Instead the continuing presence of abrasive is beneficial because a cutting jet can be started and stopped multiple times per second to carry out dynamic machining operations. When a cutting head is operated in a dynamic cutting mode, controlled penetration of abrasive into a waterjet generating means can be an advantage in that cutting begins instantaneously on re-starting water flow avoiding distortion, cracking and de-lamination of thin and fragile workpiece materials.

An AWJ cutting head projects a waterjet a distance of 40 to 80 waterjet diameters across a chamber to drag air at sub-atmospheric pressure towards a focus tube inlet. In order to drag sufficient air into a focus tube substantially more air is caused to flow towards a focus tube than enters a focus tube. Excess air moving towards a focus tube re-circulates energetically in a chamber carrying with it abrasive particles that erode chamber walls and waterjet orifice holders. Re-circulating air may contain particles that have become wetted by water droplets. Because of particle wetting, abrasive particles may attach to the passage walls within an orifice and its holder and be displaced through an orifice when water/airflow reverses on turning off water flow.

The cutting performance of AWJ cutting heads can be improved and chamber and focus tube wear reduced if air, dragging abrasive particles along with it, enters a focus tube driven by a controllable pressure difference. A static pressure of one bar or so above atmospheric pressure causes air to accelerate to sonic velocity at the start of a focus tube bore. Efficient acceleration of air and abrasive particles into a focus tube requires the distance between the outlet of a waterjet generating means and a focus tube inlet to be the minimum necessary for abrasive particles to flow smoothly into a focus tube inlet. This results in abrasive particles flowing over the outlet of a waterjet generating means, and penetrating upstream of the waterjet generating means when water flow is stopped.

Diamond has a substantially longer life than other superhard materials when used for a waterjet generating means. A prior art waterjet orifice made of diamond may be set in sintered metal within a carrier. Bonding between sintered metal and diamond is poor and sintered metal is relatively weak in tension so the retention and sealing of a piece of diamond relies on the support provided to the sintered metal by a carrier made of steel or other strong metal. Encasing diamond or other superhard material in sintered metal is not satisfactory for abrasive waterjet cutting heads describe in this patent application because there is insufficient space between a waterjet generating means and a focus tube to adequately support and protect the sintered metal from erosion.

Thus there are several advantages in being able to provide a waterjet generating means that can pass abrasive and other particles without damage, the means being located, attached and sealed to the outlet of a carrier. In this patent application it is described how a waterjet nozzle that is not easily damaged when passing abrasive particles is attached and sealed to the outlet of a carrier so as to withstand water pressures that can exceed 4000 bar. Additionally said waterjet generating means may cover the face of its carrier such that abrasive particles are prevented from damaging the carrier.

According to a first aspect of the present invention, there is provided a nozzle assembly adapted to generate a jet of water or abrasive particles suspended in water for use in an abrasive waterjet cutting head, comprising carrier means mountable to the cutting head and having elongate passage means extending therethrough and a nozzle element comprising a superhard material, sealingly mounted to the carrier means by soldered or brazed joint means and having an elongate profiled bore extending therethrough, so connected to the passage means that water or a suspension of abrasive particles in water may be passed under pressure through the passage means and the bore to generate said jet.

Preferably, said passage means and said profiled bore each have substantially the same diameter at a point where they meet.

Advantageously, said profiled bore tapers from a first end connected to the passage means to a second end adapted to emit the jet.

At least part of said joint means may extend substantially normally to a longitudinal axis of the passage means.

Preferably, an area of the joint means is at least about ten times a cross-sectional area of the passage means at a point where the passage means and the bore meet, optionally at least twenty times said cross-sectional area.

Preferably the superhard material has a Mohs hardness of 9 to 10.

Advantageously the superhard material comprises diamond, cubic boron nitride, boron carbide, tungsten carbide, silicon carbide or aluminium oxide.

The superhard material may comprise at least one of polycrystalline diamond, monocrystalline diamond, natural diamond or diamond produced by chemical vapour deposition.

Preferably, the nozzle element comprises a block of diamond or other superhard material.

Advantageously, said superhard block is provided with a coating of a material reactively bonded thereto, optionally a metal such as titanium or a rare earth element such as lutetium.

Said superhard block may be integrally bonded to a support element of tungsten carbide or other superhard material, the support element being mounted to the carrier means by said joint means.

Said superhard block may be provided with casing means of hard metal or a different superhard material, said joint means connecting both the casing means and the superhard block to the carrier means.

The superhard material may comprise a coating, preferably a diamond coating, supported on a nozzle element body, optionally with said coating covering an interior surface of the profiled bore and a surface of the nozzle element facing away from the carrier means.

The superhard material coating may be grown by chemical vapour deposition on to a former having the desired shape of the profiled bore so as to form a thick film, the former then etched away and superhard material or metal deposited on the thick film to produce the nozzle element body.

Preferably, said joint means comprises a ductile filler metal, reactively bonded to the nozzle element and reactively or metallically bonded to the carrier means.

Advantageously, the joint means comprises an active solder comprising a tin-silver-titanium alloy, optionally doped with other metals and/or active rare earth elements such as lutetium, erbium and cerium.

The joint means may comprise an active solder comprising a zinc-silver-aluminium alloy, optionally doped with other metals and/or active rare earth elements.

The joint means may comprise an active braze comprising a silver-copper-titanium base, optionally doped with other metals and/or rare earth elements such as hafnium and zirconium.

The carrier means preferably comprises a material having a thermal expansion coefficient similar to that of the diamond or other superhard material of the nozzle element.

Advantageously, said material of similar thermal expansion comprises a lamina to which the nozzle element is soldered or brazed, the lamina being soldered or brazed to a remainder of the carrier means with a solder or braze having a higher melting temperature than that used to mount the nozzle element thereto.

According to a second aspect of the present invention, there is provided an abrasive water jet cutting head comprising a nozzle assembly as described in the first aspect above.

According to a third aspect of the present invention, there is provided a method of producing a nozzle assembly for an abrasive water jet cutting head comprising the steps of providing carrier means mountable to the cutting head, providing a nozzle element comprising a superhard material such as diamond, and sealingly mounting the nozzle element to the carrier means by means of a soldered or brazed joint.

According to a fourth aspect of the present invention there is provided a generally cylindrical carrier with a shaped central passageway that connects to a shaped bore in a piece of superhard material that is attached and sealed to said carrier by a soldered or a brazed joint in such a manner as to minimise the fluid loading on the piece of superhard material.

The diameter of the inlet in said superhard material is ideally the same as the mating passage in the said carrier, such that the maximum fluid loading to which a nozzle-to-carrier joint is subjected is due to fluid pressure acting on a nozzle bore inlet area, should a nozzle bore become blocked.

Said joint may involve a reactive bond between the superhard and a filler metal and a reactive/metallic bond between the filler metal and the carrier.

The formation of said joint may comprise applying uniaxial or isostatic pressure to induce diffusion bonding.

The carrier may have a sealing means to seal it to a source of pressurised fluid.

The bore in said piece of superhard material is generally contracting from an inlet that receives pressurised water to an outlet from which water is discharged as a high velocity waterjet.

If the pressurised water contains substantial number of abrasive particles the jet leaving the nozzle forms an abrasive waterjet.

The superhard material is preferably diamond, cubic boron carbide, tungsten carbide, silicon carbide or other superhard material having a hardness greater than or equal to that of aluminium oxide.

According to a fifth aspect of the present invention there is provided a cylindrical carrier with a longitudinal passage leading from the first end of the cylinder to a piece of superhard material joined and sealed to a surface on the second end of the said carrier. A longitudinal passage machined in said superhard material and aligned with longitudinal passage in the carrier so as to produce a waterjet or an abrasive waterjet when pressurised water or a pressurised water/abrasive particle suspension is fed to the first end of the carrier.

Advantageously the superhard nozzle material is diamond, or optionally cubic boron carbide, tungsten carbide, silicon carbide or other material with a Mohs hardness of 9 or greater.

The diamond may be in the form of polycrystalline diamond (PCD), monocrystalline diamond, chemical vapour deposition (CVD) diamond or natural diamond.

Advantageously, pieces of said superhard material may be pre-coated or metallized, preferably with a coating containing a metal such as titanium or a rare earth element such as lutetium that is reactively bonded to the superhard material.

Pieces of said superhard material may be pre-coated by a chemical vapour deposition process with tungsten carbide or other suitable material that aids in the formation of a joint to a carrier.

A nozzle bore may be formed in a piece of diamond that is integrally bonded to a tungsten carbide support or other superhard material support so that the joint is made to the carrier via the superhard material.

A nozzle may be a formed piece of diamond that is supported by a hard metal or superhard material case grown or deposited on to the diamond with the diamond and/or case joined to the nozzle carrier with a reactive joint.

Diamond or other superhard material may be encased in a support comprising metal or another superhard material and a joint made to a carrier via the diamond or other superhard material and/or its support.

A joint between superhard material and nozzle carrier is preferably formed using an active solder or braze material that reacts with the surface of superhard material to form a fully bonded transition zone between the superhard material and a ductile metallic filler material. A metallic bond is formed between ductile metallic filler material and a metallic or superhard carrier.

Active solders may consist of Sn—Ag—Ti base alloys doped with other metals and/or with active rare earth elements such as lutetium (Lu), erbium (Er) and cerium (Ce).

Active solders may consist of Zn—Ag—Al base alloys doped with other metals and/or with active rare earth elements.

Active brazes may consist of Ag—Cu—Ti base metals doped with other metals and/or active rare earth elements that may include Hf and Zr.

A joint bond area is advantageously greater than ten times the area of the inlet nozzle subjected to water pressure.

A nozzle carrier may be provided with means for it to be sealed to a flow conduit connected to a carrier inlet.

According to a sixth aspect of the present invention there is provided a cutting head assembly comprising:

- a cylindrical nozzle carrier with an internal passage connecting an inlet to a piece of superhard material attached and sealed by joining means to carrier on the opposite end to the inlet;
- said nozzle carrier normally having a precision diameter on the outside surface at the end to which the superhard material is joined;
- a shaped bore in said superhard material accurately located on centerline of precision diameter on outside surface of orifice body;
- a means to effect a fluid seal between a tube feeding pressurised water or suspension of abrasive in water to the nozzle carrier and the carrier inlet;
- a cutting head body with a precision bore into which said nozzle carrier body can be located;
- said cutting head body provided with a connection more or less perpendicular to the longitudinal axis of cutting head body for entry of carrier fluid carrying abrasive particles;
- a superhard focus tube that fits into the opposite end of a cutting head bore to a nozzle carrier;
- an insert that sits in cutting head body bore between a nozzle and a focus tube, with a passageway to connect the outlet of said nozzle to the focus tube inlet and a passageway to connect an abrasive/carrier fluid entry connection in the cutting head body to a passageway between the nozzle and the focus tube inlet; and
- means to individually locate and secure the nozzle carrier, the insert and the focus tube in the cutting head body.

The superhard nozzle material is preferably diamond.

A diamond nozzle is preferably attached to a nozzle body by soldering or brazing in a vacuum or inert gas furnace using a metal alloy containing titanium or other active elements that react with diamond and nozzle carrier substrate to enable chemical bonds to form between the metal alloy and diamond and carrier.

The carrier may be a material such as molybdenum, Kovar, Invar or a copper/tungsten alloy that has a similar thermal expansion to diamond or other superhard material used for the nozzle.

A thin section of material having a compatible thermal expansion to a nozzle material may be soldered or brazed to a carrier using a higher melting temperature solder or braze than that used to solder or braze a nozzle to the material.

According to a seventh aspect of the present invention there is provided a cutting head with a body into which an exchangeable waterjet nozzle assembly and a focus tube are assembled to configure a cutting head to operate with abrasive particles carried in a gas, or in a vapour or in a vapour/gas mixture, or in a liquid. If abrasive particles flow to a cutting head as a suspension in a pressurised liquid the cutting head body, the insert and the focus tube can be removed to allow the nozzle assembly to act as a cutting head.

Examples of nozzles and cutting heads embodying the present invention will now be described by way of example and with reference to the accompanying drawings, in which:

FIGS. 1*a* to 1*e* show nozzle assemblies;

Figure 8:
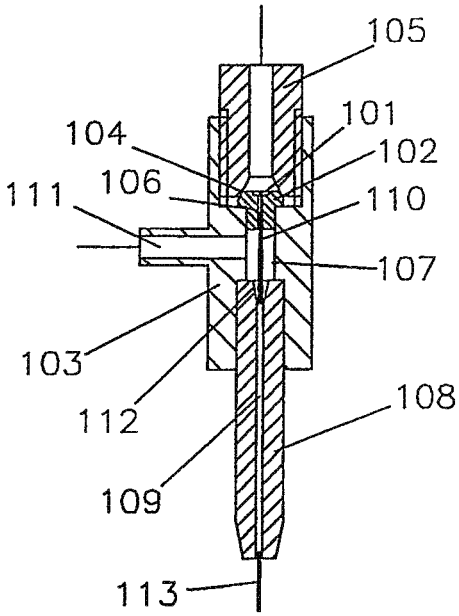
FIG. 8 shows a prior art cutting head.

Referring first to FIG. 8, for understanding of the prior AWJ art, a waterjet orifice 101 is located and sealed in the front face of a substantial carrier 102 that is located within a cutting head body 103. A seat 104 on the carrier 102 mates and forms a metal to metal seal with a tube 105 feeding ultra high pressure water to orifice 101. Water flowing through the orifice contracts to form a jet 110. The waterjet 110 passes through a central passageway 106 in carrier 102 before traversing a chamber 107 and entering a bore 109 of a focus tube 108. The drag caused by waterjet 110 passing through chamber 107 causes air dragging abrasive particles with it to enter through passageway 111 and to be accelerated towards and enter the focus tube 108. The quantity of air moving towards focus tube inlet 112 is greater than that that can enter bore 109 and the excess air re-circulates within chamber 107, carrying abrasive particles, in an unstable manner with strong swirl components. In the focus tube bore 109 momentum is transferred from the waterjet to abrasive particles to produce a cutting jet 113.

Orifice 101 is made of sapphire, ruby or diamond. Sapphire, ruby and diamond are extremely hard but also brittle, so an orifice's edge can be damaged by particles moving at high velocity. Locating orifice 101 such that a waterjet 110 passes through a narrow passage 106 substantially reduces the risk of abrasive particles reaching the vicinity of an orifice and travelling upstream of an orifice during transient events when water flow is stopped.

An advantageous feature of prior art is the location of the waterjet generating means 101 on the front face of a carrier 102 so that water pressure acts to hold and seal the means to the carrier. A further advantageous feature of prior art cutting heads is the size of piece of diamond need only be sufficient to carry water pressure compression loads so that it is economic to use high quality natural or synthetic diamond.

However, with a waterjet generating means on the front face of a carrier it is not possible to prevent adverse fluid dynamic processes in cutting heads or to induce desirable fluid dynamic processes. Adverse fluid dynamic processes are so severe that prior art entrainment cutting heads do not function effectively with abrasive carried in water or in steam.

It is now described how a waterjet generating nozzle made from diamond or other superhard material, with a shaped bore that is not readily damaged by abrasive particles, is attach and sealed to the outlet of a carrier to withstand water pressures that can exceed 400 MPa. A loading of 400 Mpa is ten or so times the tensile strength of joining methods for diamond to metal or other superhard materials. Taking account of the extreme fatigue loads from cyclic water pressures a joint area twenty or so times the nozzle area subjected to water pressure is desirable. Critically, to prevent pressurised water entering a joint and thereby increasing the fluid loading on a joint, the joint material must form water impervious seal between a carrier and a nozzle.

Joining superhard materials to a metal or other superhard material by soldering or brazing is known in the art. However, the extreme tensile loading caused by ultra high water pressures and catastrophic increases in loading if water penetrates into a joint means that experimentation is required to establish soldering and brazing methods for each combination of waterjet nozzle material with carrier material.

Diamond is preferred for its wear characteristics but stronger joints can be made with tungsten carbide and other superhard materials and these materials can be easier to machine to produce nozzle bores as well as easier to solder or braze. Therefore, it is desirable to select a superhard nozzle material based on many factors.

For illustration joining of diamond to metal or to another superhard material using soldering and brazing is described but it is understood that similar joining methods could be used to join other superhard nozzle materials to metal or another superhard material.

For clarity superhard materials are here defined as materials having a hardness of 9 or higher on the Mohs scale.

Figure 1A:
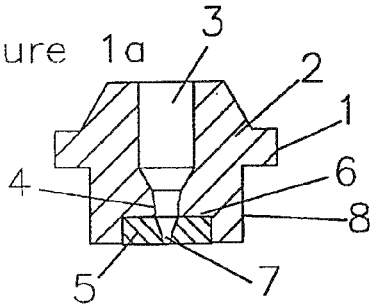

Referring now to FIG. 1*a*, showing a nozzle assembly embodying the present invention, a waterjet nozzle 1 has a carrier 2 with an inlet 3 to passage 4 that contracts to a shaped bore 7 in a piece of diamond material in the form of a blank that forms a nozzle 5. The nozzle 5 is joined and sealed to carrier 2 by a joint 6. In order to minimise the fluid loading on a joint 6 the outlet diameter of the flow passage 4 in the carrier 2 will usually be chosen to be the smallest practical consistent with water velocities being below the erosion velocity of the material of the carrier 2 and the need to carrying out drilling and polishing operations to form the nozzle bore 7.

The joint 6 between a diamond blank 5 and a nozzle carrier 2 is effected using a solder or braze alloy that is doped with active elements. An example of such a solder is a tin (Sn)-silver (Ag) alloy with active elements titanium (Ti), gallium (Ga) and cerium (Ce). An example of active braze is a silver (Ag)-copper (Cu) alloy with titanium (Ti) and other active elements. The active elements react with oxide layers and surfaces to allow wetting. A good joint has extensive chemical bonding between solder or braze material, diamond and carrier material, with minimal formation of undesirable interfacial compounds and brittle and other joint weakening layers.

Although solders are generally defined as having melting points below about 450° C., it can be advantageous to carry out part of a soldering cycle at higher temperatures. In such cases, temperatures up to 850° C. or so may be used to bring about wetting, before reducing the temperature to form a joint that has lower residual thermally induced stresses than that generated by a brazed joint (brazing of superhard materials generally involves solidus temperatures above 700° C.).

The carrier 2 can be fully machined before the nozzle 5 blank is attached, with the joint face on a carrier having a machined surface texture to maximise joint strength. Brazing of batches of nozzles is normally carried out in a vacuum or inert gas furnace. A solder or braze preform cut from foil is positioned between a holder 2 and diamond blank 5. A soldering or brazing temperature/time cycle is used that ensures good joint properties and minimises residual stresses in the brittle diamond. Brazing provides stronger joints and is preferred for joining diamond that is thermally stable at brazing temperatures above 800°. Ultrasonic or other vibration means may be used to help in achieving a satisfactory joint.

Solder and braze materials have poor capillary and wetting characteristics on diamond and wetting is time dependent. The poor wetting characteristic may be used as an indicator of successful joint formation. The central hole in a solder or braze resist is machined marginally larger than the outlet of passage 4. After a solder or braze cycle the successful flow of joint material to form the critical seal between a joint 6 and carrier passage bore 4 can be observed.

It is advantageous not to polish the growth side of CVD diamond and to use the rough growth surface of the diamond as the joint surface in order to increase joint bond area.

For quality control and to minimise costs it is desirable to have only one operation in producing a joint that can withstand extreme pressures and fatigue loading. However, if problems arise in making joints with particular diamond nozzle blanks 5, the blanks may be pre-coated with a titanium-based or other coating that forms a reacted chemical bond with the blank and is wetted during soldering or brazing. Alternatively, a blank may be pre-coated by a chemical vapour deposition process with tungsten carbide or other suitable material that aids in the formation of a joint to a carrier.

For generating waterjets up to 400 μm or so in diameter, and abrasive suspension waterjets under about 200 μm or so in diameter, diamond or other superhard material blanks of 1 to 3 mm in thickness and 3 to 6 mm in diameter are appropriate.

The shape of the bore 7 machined in a nozzle blank 5 depends on the application. A bore 7 for a nozzle that passes a suspension of abrasive in pressurised water will typically have a simple rounded or conical inlet, with a length equivalent to four or so bore diameters, followed by a near constant diameter bore ten to twenty diameters long.

Friction losses in each diameter of bore in the approach to a waterjet nozzle outlet are 2% or so of the waterpower at a cutting head inlet. The aim is to balance the friction energy losses in a nozzle against creating waterjet characteristics that are effective in entraining abrasive particles into a focus tube and transferring kinetic energy from the waterjet to the particles in a focus tube bore. For a cutting head that entrains abrasive as a suspension in water, the distance between a nozzle outlet and a focus tube may only be a few waterjet diameters, making it desirable to maximise the entrainment capability of a jet on exit from a nozzle. This is achieved using a conical contraction of 15° or so, followed by a parallel section of two or so diameters before a waterjet nozzle outlet. This geometry generates a jet with a turbulent surface due to cavitation and friction.

For abrasive particles carried in air to a cutting head, a waterjet may travel ten or more jet diameters before entering a focus tube. In this situation the near parallel outlet length of a nozzle needs to be just sufficient for the nozzle outlet to withstand water pressure loads and particle impacts.

FIGS. 1*b*, 1*c*, 1*d* and 1*e* show alternative carrier and nozzle arrangements.

Figure 1B:
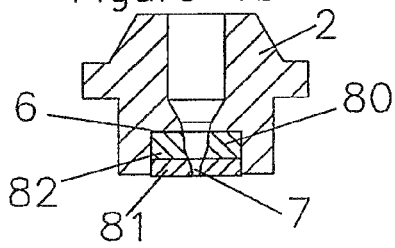

FIG. 1*b* shows a nozzle 80 made from diamond formed as an integral layer 81 on a tungsten carbide or other substrate 82 that is brazed 6 onto carrier/holder 2.

Figure 1C:
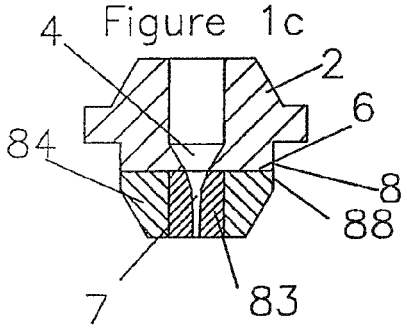

FIG. 1*c* shows a nozzle consisting of a piece of diamond 83, such as PCD, encased in tungsten carbide 84, which is brazed to carrier 2 via both the diamond 83 and the tungsten carbide 84. The exterior 88 of the tungsten carbide case 84 can be machined to extreme tolerances as can nozzle holder diameter 8, allowing the bore 4 in the holder 2 and the bore 7 in the diamond 83 to be pre-drilled and accurately mated during brazing. The tungsten carbide case 84 may be grown or deposited on to the diamond 83. A hard metal may in some cases be used instead of tungsten carbide or similar superhard materials.

Figure 1D:
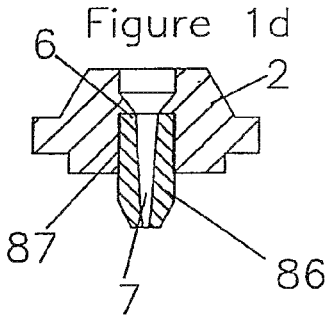

FIG. 1*d* shows a nozzle arrangement that is particularly appropriate for miniature cutting heads in which it is difficult to provide an adequate flow passage for abrasive in water mixtures to reach a nozzle outlet. A piece of diamond 86 is brazed on its inlet face to provide a water seal with the majority of fluid loads carried by brazed joint 87 on the sides of the diamond. The diamond may be of rectangular or other cross-section.

Figure 1E:
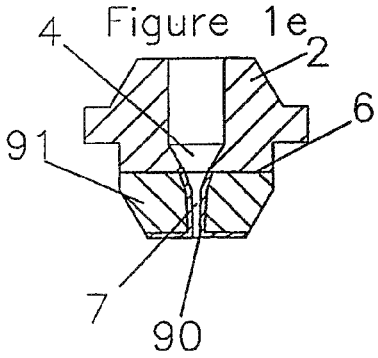

FIG. 1*e* shows a nozzle formed by the deposition or growth of a CVD diamond or other superhard material layer 90 in a bore 7 within a body 91 that is joined and sealed to carrier 2 by joint 6. The layer of superhard material 90 may extend over the outlet face of the body 91 to protect the carrier 2 from erosion by abrasive particles. The joint 6 may be made to the superhard material 90 as well as to the body 91.

Instead of growing CVD diamond or other superhard material within the bore 7, a thick film may be grown on a former having a desired shape of bore 7, the former etched away, and a metal or superhard material case deposited or grown on the outside of the thick film to form the body 91.

PCD and other diamond or superhard material blanks used for nozzles 5, 80 and 83 may be cut from sheet material with an external shape that includes features that form part of passageways for abrasive in a carrier fluid to flow and be entrained into a waterjet leaving bore 7.

Where tungsten carbide is used as the superhard material, a particularly suitable form is the composite carbide sold under the Registered Trade Mark ROCTEC, as used in abrasive waterjet focus tubes by Kennametal Inc of Traverse City, Minn., USA.

Figure 2:
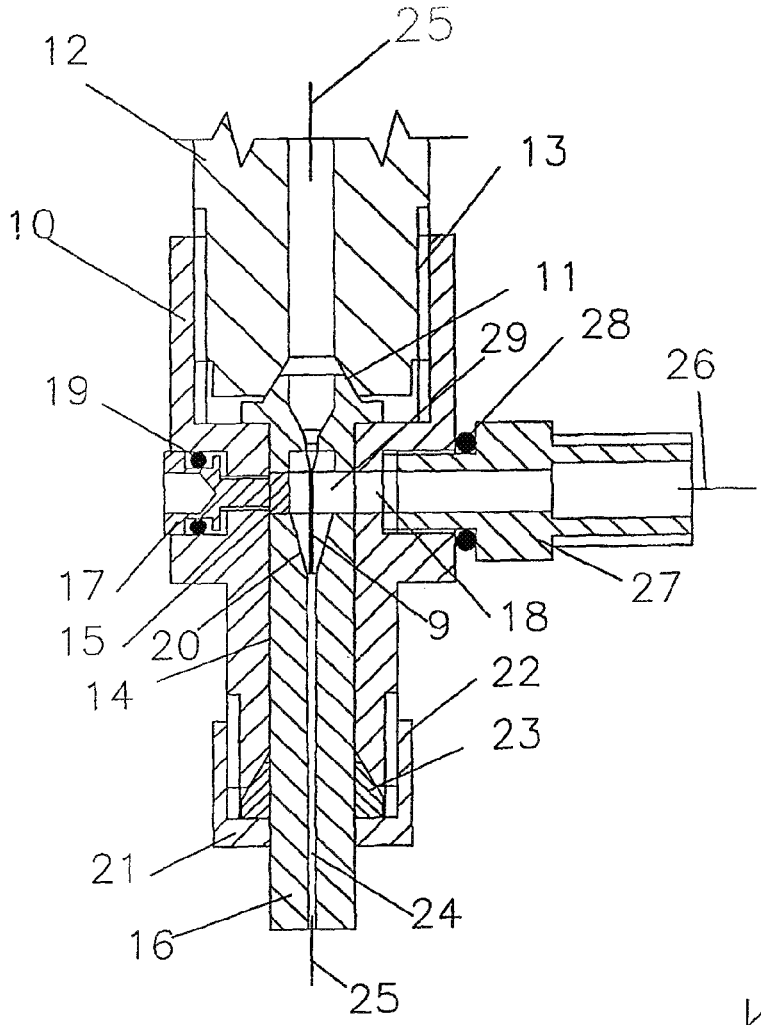
FIGS. 2 and 3 show entrainment cutting heads.

FIG. 2 shows a cutting head for entraining abrasive particles carried in a carrier fluid. A waterjet nozzle 1 as shown in any of FIGS. 1*a* to 1*e* is located in the body 10 of a cutting head and sealed against seat 11 on collimation tube 12 by loading applied in attaching body 10 to collimation tube by thread 13. The cutting head body 10 has a bore 14 that locates outside diameter 8 of waterjet nozzle 1 and into which a spacer 15 and focus tube 16 are assembled. Locating device 17 sealed to body 10 by seal 19 positions the spacer 15 relative to a passageway 18 in body 10. A gland nut 21 with thread 22 loads sealing and retaining ring 23 to hold and to seal focus tube 16 in bore 14 of body 10.

Pressurised water source 25 to collimation tube 12 flows via passageways 3 and 4 to the nozzle bore 7 to generate a waterjet 9. The waterjet 9 passes through chamber 29 formed in spacer 15 and enters inlet 20 and bore 24 of focus tube 16. Abrasive particles in a carrier fluid 26 flow through connection 27 to a passage 18 in cutting head body 10 into chamber 29 and on into inlet 20 of focus tube 16. In the focus tube bore 24, kinetic energy is transferred from the water jet 9 to abrasive particles to give a cutting jet 25 at the focus tube 16 outlet. The longitudinal alignment of bore 7 in nozzle waterjet nozzle 1 and bore 24 in focus tube 16 is achieved by their bore axis being concentric with their diameters and their outside diameters being a close tolerance in the bore 14 of body 10. Connection 27 is sealed to the body 10 by seal 28.

Figure 3:
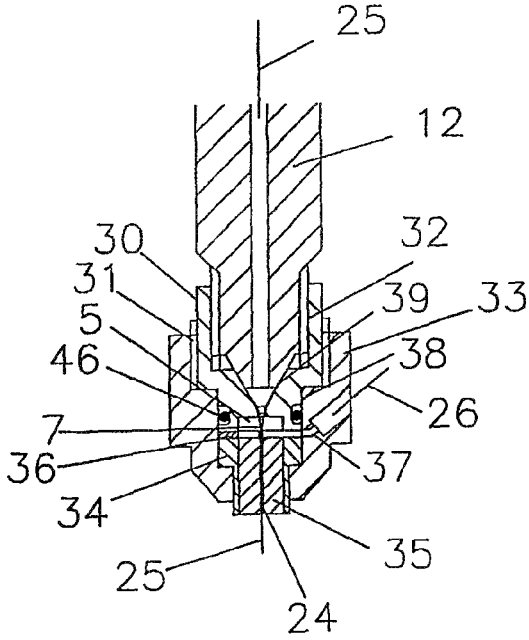

FIG. 3 shows a compact cutting head that has a nozzle carrier 30 directly attached to a collimation tube 12 feeding pressurised water to a cutting head. The fluid dynamics of the cutting head are basically the same as for the cutting head of FIG. 2. The nozzle carrier 30 is extended on its inlet end relative to the carrier 2 of FIG. 1 and has internal threaded 32 and external threaded 31 sections. The metal to metal seal 39 between the carrier 30 and the collimation tube 12 is made to a contracting bore in the carrier 30. Cutting head body 33 is attached to nozzle carrier 30 by a thread 31 in the arrangement show. The focus tube 35 is fixed in a carrier 34. Screwing body 33 onto nozzle carrier 30 with thread 31 holds focus tube carrier 34 and spacer 36 in place.

A flow of abrasive particles in a carrier fluid 26 enters passage 37 at an angle to keep the connection to the body 33 away from abrasive reflected from workpieces. The nozzle carrier is sealed to the cutting head body 33 by seal 46.

Figure 4:
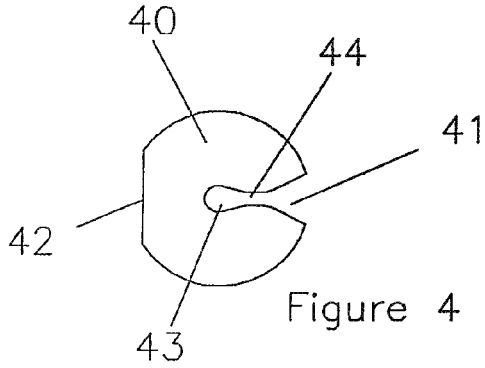
FIG. 4 shows a spacer.

FIG. 4 shows a spacer 40 suitable for the cutting head shown in FIG. 3. Spacer 40 has an inlet contraction 41 that connects to passageway 37 in cutting head body 33 and a metering section 44. Metering section 44 connects to chamber 43 through which waterjet 9 flows from nozzle 7 to focus tube 35. A flat 42 or other feature on spacer 40 may match with a feature in cutting head body 33 to locate the passage 41 relative to the passageway 37. Alternatively passage 37 and chamber 39 can be machined into focus tube carrier 34 and focus tube 35.

Figure 5:
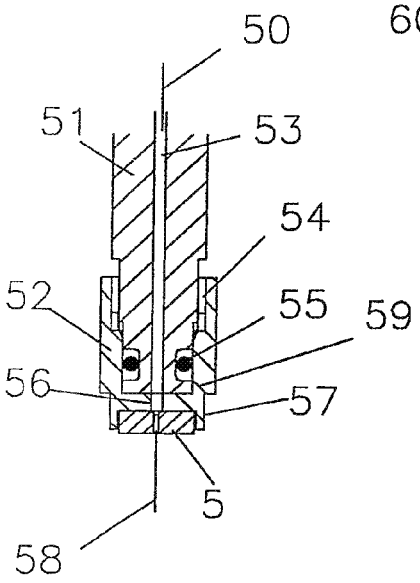
FIG. 5 shows an abrasive suspension cutting head.

FIG. 5 shows a nozzle arrangement 59 that is particularly suited to generating small diameter abrasive waterjets. A source 50 of pressurised abrasive/water flows through passageway 53 in collimation tube 51 to a passage 56 in nozzle holder 52 to a nozzle 5. Nozzle carrier 52 is retained on collimation tube 51 by thread 54 and sealed to collimation tube 51 by seal 55. The interface between passageways 53 and 56 is such that abrasive particles cannot accumulate in dead spaces. The diameter of the diamond blank used for nozzle 5 can be chosen to protect holder 52 from abrasive when abrasive waterjet 58 is reflected from a workpiece.

Figure 6:
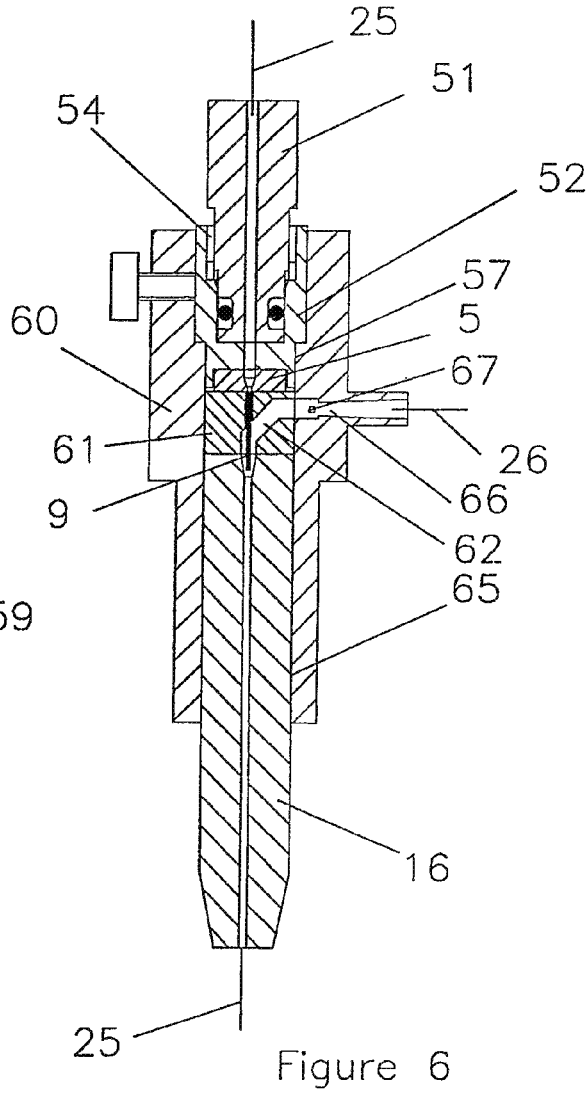
FIGS. 6 and 7 show entrainment cutting heads.

FIG. 6 shows an entrainment cutting head with a nozzle assembly 59 as shown in FIG. 5 and a spacer 61 suitable for use when the abrasive particle carrier fluid is air. Diameter 57 on nozzle carrier 52 is concentric with the bore of nozzle 5 and locates within bore 65 of cutting head body 60 into which spacer 61 and focus tube 16 fit. Spacer 61 has passage 62 that is aligned with passage 66 in body 60. Passage 66 is connected to a source 26 of abrasive particles suspended in a carrier fluid.

One or more passages 67 in body 60 connected to passage 66 may be used to bleed off carrier fluid flow 26 when the carrier fluid flow required into focus tube 16 is insufficient to transport abrasive particles from a source to passage 66. Passage 66 may be shaped to increase particle momentum past passage 67 and thereby minimise abrasive particles entering passages 67. Bleeding off carrier fluid through passage 67 is particularly advantageous for generating cutting jets less than 500 μm in diameter when the carrier fluid is air.

Figure 7:
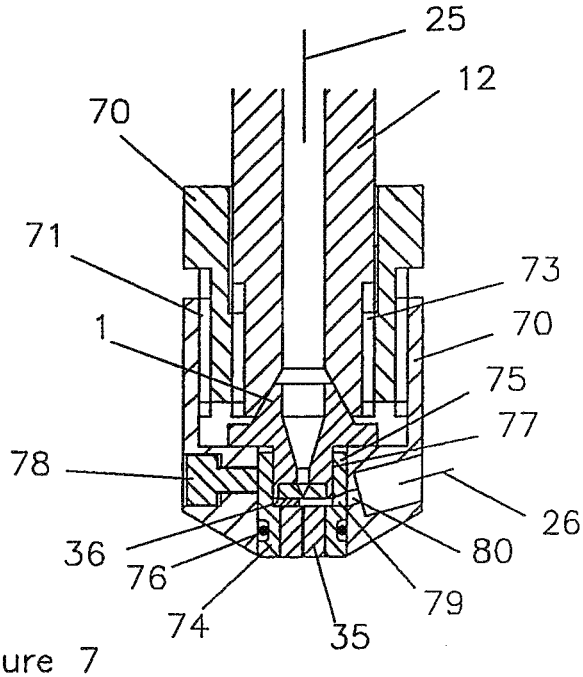

Below focus tube bore diameters of 100 μm or so, alignment of the bores of a nozzle and a focus tube need to be held to 5 μm or so. FIG. 7 shows an arrangement that is particularly suited to achieving good alignment of nozzle and focus tube bores. A focus tube 35 is located in carrier 74 with an extended section 75 that is a close fit on the outside diameter 77 of nozzle carrier 1. By referencing the location of the nozzle bore to outside diameter 77 and focus tube bore to the inner bore of the extended section 75 alignment to better than 5 μm can be achieved.

The nozzle carrier 1 is retained by body 72 that is attached to a collar 70 by thread 71. Collar 70 is attached to collimation tube 12 by thread 73. Thread 71 joining body 72 and collar 70 may be replaced by a quick release interrupted thread or other quick release mechanism so that by unscrewing collar 70 slightly, to release loading between nozzle carrier 1 and collimation tube 12, the body 72 can be rotated a part turn and released.

Focus tube 35 may be retained in focus tube carrier 74 by a shrink fit, adhesive, brazing or other joining and sealing means. Seal 76 seals the focus tube carrier 72 to the body 72. Location screw 78 holds a focus tube carrier 74 so that the passage 79 in focus tube carrier is aligned with passage 80. Passage 80 in body 72 connected to a source 26 of abrasive particles in a carrier fluid. The fluid dynamic operation of this cutting head is generally as described with reference to FIG. 2.

The invention claimed is:

1. A nozzle assembly adapted to generate a high-pressure jet of water for use in an abrasive waterjet cutting head, the nozzle assembly comprising:

a carrier mountable to the cutting head and having an elongate passage extending therethrough; and a nozzle element comprising a superhard material having a hardness of 9 or higher on the Mohs scale, the nozzle element being sealingly mounted to a downstream-facing surface of the carrier by a soldered or brazed joint in tension and having an elongate profiled bore extending therethrough, the nozzle element being connected to the passage that water may be passed under pressure via and through the passage to the bore to generate said jet, wherein the passage and the profiled bore each have substantially the same diameter at a point where the passage and the profiled bore meet.

2. A nozzle assembly as claimed in claim 1, wherein said profiled bore tapers from a first end connected to the passage to a second end adapted to emit the jet.

3. A nozzle assembly as claimed in claim 1, wherein at least part of said joint extends substantially normally to a longitudinal axis of the passage.

4. A nozzle assembly as claimed in claim 1, wherein an area of the joint is at least about ten times a cross-sectional area of the passage at a point where the passage and the bore meet.

5. A nozzle assembly as claimed in claim 1, wherein the superhard material comprises diamond, cubic boron nitride, boron carbide, tungsten carbide, silicon carbide, aluminium oxide, or combinations thereof.

6. A nozzle assembly as claimed in claim 1, wherein the superhard material comprises at least one of polycrystalline diamond, monocrystalline diamond, natural diamond, diamond produced by chemical vapour deposition, or combinations thereof.

7. A nozzle assembly as claimed in claim 1, wherein the nozzle element comprises a block of diamond or other superhard material.

8. A nozzle assembly as claimed in claim 7, wherein said superhard block is provided with a coating of a material reactively bonded thereto.

9. A nozzle assembly as claimed in claim 7, wherein said superhard block is integrally bonded to a support element of tungsten carbide or other superhard material and the support element is mounted to the carrier by said joint.

10. A nozzle assembly as claimed in claim 7, wherein said superhard block is provided with a casing of hard metal or a different superhard material, and said joint connects both the casing and said superhard block to the carrier.

11. A nozzle assembly as claimed in claim 1, wherein the superhard material comprises a coating or a thick film, preferably a diamond coating or thick film, supported on a nozzle element body, optionally with said coating or thick film covering or forming an interior surface of the profiled bore and a surface of the nozzle element facing away from the carrier.

12. A nozzle assembly as claimed in claim 1, wherein said joint comprises a ductile filler metal, reactively bonded to the nozzle element and reactively or metallically bonded to the carrier.

13. A high-pressure abrasive water jet cutting head comprising a nozzle assembly including:

a carrier including elongate passage extending therethrough; and a nozzle element comprising a superhard material having a hardness of 9 or higher on the Mohs scale, the nozzle element being sealingly mounted to a downstream-facing surface of the carrier by a soldered or brazed joint in tension and having an elongate profiled bore extending therethrough, the nozzle element being connected to the passage that water is to be passed under pressure via and through the passage to the bore to generate the abrasive water jet, wherein the passage and the profiled bore each have substantially the same diameter at a point where the passage and the profiled bore meet.

14. A method of producing a nozzle assembly for a high-pressure abrasive water jet cutting head, the method comprising:

mounting a carrier to the cutting head, the carrier including an elongate passage extending through the carrier;

providing a nozzle element comprising a superhard material having a hardness of 9 or higher on the Mohs scale such as diamond, the nozzle element having an elongate profiled bore extending therethrough, wherein the elongate passage of the carrier and the elongate profiled bore of the nozzle element each have substantially the same diameter at a point where they meet; and sealingly mounting the nozzle element to a downstream-facing surface of an outlet of the carrier by means of a soldered or brazed joint in tension, wherein the nozzle assembly is configured so that water is passed under pressure via and through the elongate passage to the elongate profiled bore to generate a jet of water.

15. The nozzle assembly as claimed in claim 1, wherein an area of the joint is at least about twenty times a cross-sectional area of the passage at a point where the passage and the bore meet.

16. A nozzle assembly as claimed in claim 8, wherein said coating of a material includes a metal, titanium, a rare earth element, or lutetium.

* * * * *

UNITED STATES PATENT AND TRADEMARK OFFICE

CERTIFICATE OF CORRECTION

PATENT NO. : 8,439,726 B2
APPLICATION NO. : 12/083954
DATED : May 14, 2013
INVENTOR(S) : Donald S. Miller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 702 days.

Signed and Sealed this
Thirteenth Day of May, 2014

Michelle K. Lee

Michelle K. Lee
*Deputy Director of the United States Patent and Trademark Office*